United States Patent [19]

Nielson

[11] Patent Number: 4,974,982

[45] Date of Patent: Dec. 4, 1990

[54] KEYRING POCKET PEN

[76] Inventor: Thomas W. Nielson, 2074 E. 9100 South, Sandy, Utah 84093

[21] Appl. No.: 482,927

[22] Filed: Feb. 22, 1990

[51] Int. Cl.[5] ..... A44B 15/00; B43K 29/00

[52] U.S. Cl. ..... 401/195; 401/213; 401/243; 70/456 R

[58] Field of Search ..... 401/243, 244, 246, 247, 401/213, 195, 245; 70/456 R

[56] References Cited

U.S. PATENT DOCUMENTS

| | | | |
|---|---|---|---|
| 692,009 | 1/1902 | Gilbert | 401/247 |
| 1,546,715 | 7/1925 | Salvento | 401/195 |
| 1,780,527 | 11/1930 | Kolber | 401/165 |
| 1,808,489 | 6/1931 | Bassi | 401/243 X |
| 4,018,536 | 4/1977 | Brenner | 401/292 |
| 4,631,770 | 12/1986 | Goldberg | 70/456 R |
| 4,833,902 | 5/1989 | Mori | 70/456 R |

FOREIGN PATENT DOCUMENTS

| | | | |
|---|---|---|---|
| 1067849 | 12/1963 | United Kingdom . | |
| 2185219 | 7/1987 | United Kingdom | 401/195 |

*Primary Examiner*—Richard J. Johnson

*Attorney, Agent, or Firm*—Fleit, Jacobson, Cohn, Price, Holman & Stern

[57] ABSTRACT

A three piece pen is provided including a short elongated cap having a first open internally threaded end, an elongated pen holder of a length greater than the cap and including a pen point at one end and a hollow elongated tubular barrel having a first open, internally threaded end is provided. The second end of the cap includes structure for anchoring a keyring thereto, the second end of the barrel is closed and the second end of the pen holder remote from the point includes a circumferentially extending enlarged abutment spaced from the terminal end thereof. The second end of the pen holder further includes externally threaded shoulders on opposite sides of the abutment and upon each of which shoulders the internally threaded ends of the cap and barrel may be removably threadingly engaged, those portions of the shoulders immediately adjacent the abutment including reduced diameter bands in which O-rings are seated of outside diameters to be snugly received within smooth counter bores formed in the terminal ends of the internally threaded open ends of the cap and barrel.

11 Claims, 1 Drawing Sheet

FIG. 1
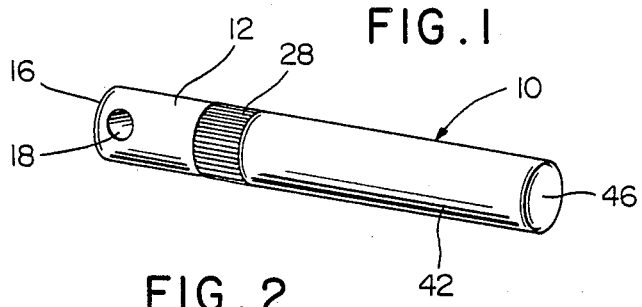
FIG. 2
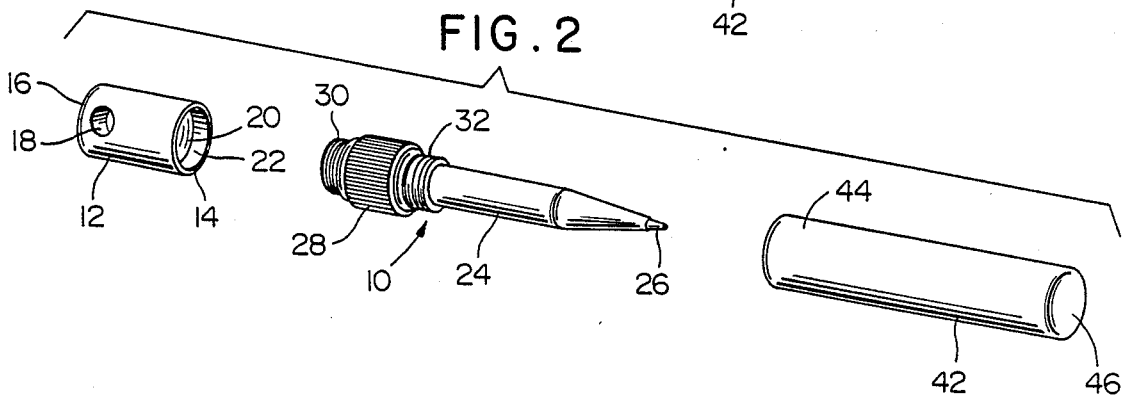
FIG. 3
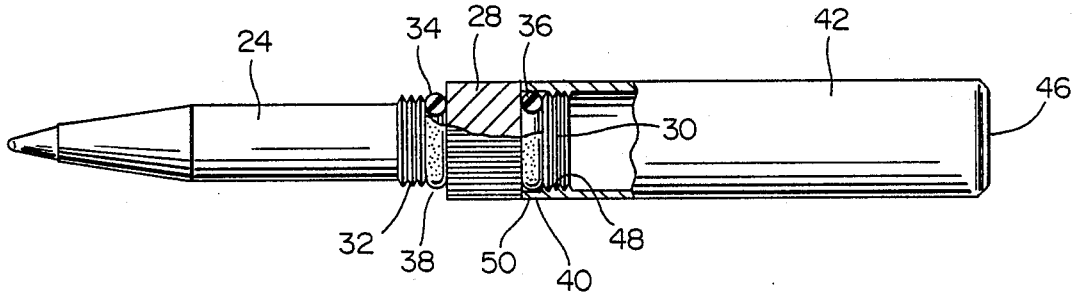
FIG. 4
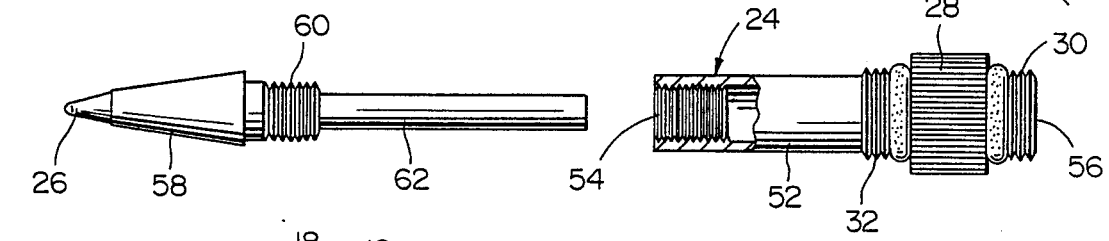
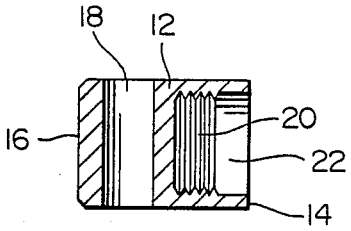
FIG. 5

KEYRING POCKET PEN

BACKGROUND OF THE INVENTION

1. Field of the Invention

This invention relates to a writing instrument and more specifically to a compact writing instrument to which a keyring may be attached and which is, in its compact state, relatively short (approximately two and one quarter inches long), but which may be partially disengaged from the associated keyring and transformed into an extended length writing instrument (approximately three and one quarter inches in length) to provide the user a comfortably usable writing instrument separate and apart from the keyring attached component thereof and any keys supported on the associated keyring.

2. Description of Related Art

Various different forms of compact writing instruments heretofore have been provided such as those disclosed in U.S. Pat. Nos.: 1,780,527 and 4,018,536 as well as Great Britain Pat. Nos.: 1,067,849 and 2,185,219.

However, these previously known forms of compact writing instruments do not include features thereof which enable the writing instruments to be attached to keyrings and any keys supported therefrom in a compact stored state and yet removable from a component of the writing instrument attached to the associated keyring and extendible into a writing instrument which may be used in a comfortable manner by a person accomplishing writing task.

SUMMARY OF THE INVENTION

The writing instrument or keyring pocket pen of the instant invention consists of (1) a short elongated cap having a first open end, (2) an elongated pen holder of a length greater than the cap and including a pen point at one end and (3) a hollow elongated tubular barrel open at one end and closed at the other end. The open ends of the cap and barrel are provided with like internal threads and the other end of the pen holder includes a circumferentially extending, enlarged abutment spaced from the terminal thereof as well as externally threaded zones on both sides of the abutment removably threadingly engagable in the aforementioned open ends and the other end of the pen holder. The other end of the pen holder, between the enlarged abutment and each of the externally threaded zones thereof, further includes an axially short, circumferentially extending band of reduced diameter in which the inner peripheral portions of associated resilient O-rings are seated.

The cap is designed to remain attached to an associated keyring and the tubular barrel and pen holder are to be unthreaded from the cap, as a unit when a writing task is to be performed, and the barrel then is removed from the one pen point supporting end of the pen holder and threadedly engaged with the other threaded end of the pen holder in order to extend the length thereof. The O-rings are used not only as seal structures between the pen holder and the cap and barrel, but also as friction generating structure to prevent the cap and barrel from loosening their threaded engagements with the pen holder.

The main object of this invention is to provide a writing instrument which may be carried in a longitudinally compact state upon a keyring, as a novel adornment therefore, and yet which may have two of three components thereof removed from engagement with the third attached to an associated keyring. The two removed components then may be disengaged from each other and reengaged in an extended length condition to provide a writing instrument of sufficient length to be comfortable in use.

Another object of this invention is to provide a writing instrument incorporating a ball point pen point (and attendant ink supply) which is entirely fluid-tight sealed within a container therefore when the writing instrument is in the non-use state thereof comprising merely an adornment for a keyring.

Still another important object of this invention is to provide a multi-component writing instrument whose individual components are removably threadingly engaged with each other and provided with friction generating means by which the three components of the writing instrument are prevented from accidental unthreading from each other.

A final object of this invention to be specifically enumerated herein is to provide a writing instrument in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view (slightly enlarged) of a writing instrument constructed in accordance with the present invention and adapted to have one of the three separable components thereof supported from a keyring;

FIG. 2 is an exploded perspective of the writing instrument illustrating the three individual threadingly engagable components thereof;

FIG. 3 is an enlarged side elevational view of the two components of the writing instrument which are threadingly engaged with each other in order to provide a writing instrument of sufficient length to be comfortable in use, parts of the barrel and pen holder components of the writing instrument being broken away and illustrated in vertical section;

FIG. 4 is an exploded side elevational view of the pen holder component of the instant invention with the ball point and ink supply therefore disengaged from the remainder of the pen holder, parts of the remainder of the pen holder being broken away and illustrated in vertical section; and FIG. 5 is an enlarged longitudinal vertical sectional view of the cap portion of the invention.

DESCRIPTION OF THE PREFERRED EMBODIMENT

Referring now more specifically to the drawings the numeral 10 generally designates the writing instrument or keyring pocket pen of the instant invention.

As may be seen from FIG. 2 of the drawings, the writing instrument 10 includes a short elongated cap 12 having a first open end 14 and a second closed end 16, the closed end 16 being solid and having a diametric bore 18 formed therethrough. The cap 12 is internally threaded as at 20, but the interior of the terminal end of the open end 14 defines an axially short smooth counter bore 22.

The writing instrument 10 also includes an elongated pen holder 24 including a ball pen point 26 at one end and with the other end of the pen holder 24 including a circumferentially extending, diametrically enlarged abutment 28 closely adjacent, but spaced axially from the terminal end of the end of the pen holder 24 remote from the ball pen point 26.

The other or second end of the pen holder 24 upon which the abutment 28 is formed also includes externally threaded circumferential zones 30 and 32 on opposite sides of the abutment 28, the zone 30 being formed on the terminal end of the pen holder 24 remote from the ball pen point 26. Still further, the other end of the pen holder 24 remote from the ball pen point 26 also includes axially short circumferentially extending bands 34 and 36 of reduced diameter in which the inner peripheries of resilient O-rings 38 and 40 are seated.

The writing instrument or keyring pocket pen 10 additionally includes a third major component comprising a hollow elongated tubular barrel 42 open at one end 44 and closed at the other end 46. The open end 44 is internally threaded as at 48, but the terminal end of the open end 44 includes a diametrically enlarged smooth counter bore 50.

With attention more invited more specifically FIG. 4, it may seen that the pen holder 24 includes a tubular body 52 open and internally threaded as at 54 at one end and closed at its other end 56, the threaded zone 30 being formed on the closed end 56. The ball pen point 26 is carried by one end of a tapered carrier body 58 whose other end is externally threaded as at 60 and has a tubular ink supply 62 endwise projecting outwardly therefrom. The other end 60 of the carrier body 52 is removably threadingly engaged in the threaded open end 54 of the body 52 (or compression fitted therein in the event the threads 54 and 60 are not provided) in order to complete the pen holder 24 and body 58. The ball pen point 26 and tubular ink supply 62 need not be disengaged from the body 52 until such time as it is required to replenish the ink supply 62 or replace the entire unit comprising the point 26, the carrier body 58 and the tubular ink supply 62.

In operation, the keyring pocket pen or writing instrument 10 usually is in the state thereof illustrated in FIG. 1 with the cap 12 threadingly engaged with the threaded zone 30 and the threads 48 threadingly engaged with the threaded zone 32. In this state, the writing instrument 10 is approximately two and one quarter inches in length and the diametric bore 18 of the cap 12 may be utilized to receive a keyring (not shown) therethrough, any appropriate keys being carried by the keyring.

When the threads 20 are threadingly engaged with the threaded zone 30, the O-ring 40 is tightly received in the counter bore 22 and upon the reduced diameter band 34 of the end of the pen holder 24 remote from the ball pen point 26. Thus, the O-ring 40 frictionally resists unthreading relative rotation between the cap 12 and the pen holder 24. In addition, when the barrel 42 has its internal threads 48 threadingly engaged on the threaded zone 32 of the pen holder 24, the entire length of the pen holder 24 illustrated in FIG. 2 to the right of the abutment 28 is received within the hollow barrel 42 and the outer peripheral portion of the O-ring 38 is tightly received within the counter bore 50, the inner periphery of the O-ring 38 being tightly seated against the diametrically reduced band 34. Thus, the O-ring 38 develops frictional resistance between the pen holder 24 and the barrel 42 resisting relative unthreading of the pen holder 24 and the barrel 42. In addition, the O-ring 38 also serves as a fluid tight seal between the pen holder 24 and the exterior of the barrel 42 in order to prevent leakage of any ink from the pen holder 24 to the exterior of the writing instrument or keyring pocket pen 10 when the three components 12, 24 and 42 thereof are joined in the manner illustrated in FIG. 1.

If it is desired to utilize the writing instrument or keyring pocket pen 10 as a writing instrument, the pen holder 24, with the barrel 42 still attached thereto, is unthreaded from engagement with the cap 12. Thereafter, the barrel 42 is unthreaded from the threaded zone 32 and re-threadingly engaged over the threaded zone 30 to thereby provide a writing instrument which is almost twice as long as the pen holder 24, see FIG. 3.

Of course, after a writing task has been performed by the user, the barrel 42 is unthreaded from the threaded zone 30 and re-threadingly engaged with the threaded zone 32 in order to completely enclose that portion of the pen holder 24 to the left of the abutment 28 in FIG. 3 within the barrel 42. Thereafter, the assembled pen holder 24 and barrel 42 combination may be rethreadingly engaged with the cap 12 by threading the threaded zone 30 into the internal threads 20 of the cap 12.

By completely detaching the combination of the components 24 and 42 from the cap 12 when it is desired to perform a writing task, the combination comprising the pen holder 24 and the barrel 42 are disconnected from the keyring (not shown) passing through the diametric 18 and any keys supported therefrom. Thus, even though a considerably lengthened writing instrument is provided, the writing instrument is totally free of connection with any keyring and keys supported therefrom and, considering that the writing instrument comprising the pen holder 24 is considerably lengthened by threading the barrel 42 onto the threaded zone 30, the writing task to be performed may be performed in comfort and without the additional weight of a keyring and keys altering the writers signature or hindering any portion of his or her writing task.

What is claimed as new is as follows:

1. A three piece pen including (1) a short cap having a first open end, (2) an elongated pen holder of a length greater than said cap, and including a pen point at one end and (3) a hollow elongated tubular barrel open at one end and at least substantially closed at the other end, said open ends of said cap and barrel being provided with like internal threads, the other end of said pen holder including a circumferentially extending, enlarged abutment spaced from the terminal end of said other end of said pen holder, said other end of said pen holder being externally threaded along circumferentially extending zones thereof on both sides of said abutment with threads removably threadingly engagable in each of said open ends, said one end and pen point being smaller in diameter than said external threads and of a combined length less than the length of the interior of said barrel, whereby said one end and pen point may be fully contained within said barrel when the open end thereof is threadingly engaged over the external threads of the threaded zone of said other end of said pen holder remote from said terminal end, said short cap including anchor means thereon remote from said first open end thereof with which a keyring may be removably anchorably engaged.

2. The pen of claim 1 wherein the end of said cap opposite said one open end thereof is closed.

3. The pen of claim 1 wherein said enlarged abutment is generally cylindrical and of substantially the said outside diameter as said cap and tubular barrel.

4. The pen of claim 3 wherein the end of said tubular barrel remote from the open end thereof is closed.

5. The pen of claim 4 wherein the end of said short cap opposite said one open end thereof is closed.

6. The pen of claim 1 wherein said pen holder, between said enlarged abutment and each of said externally threaded zones thereof, includes an axially short, circumferentially extending band of reduced diameter, each of said bands of reduced diameter having the inner peripheral portion of an associated resilient O-ring seated thereon, each of said open ends including an enlarged inside diameter terminal end counter bore of short axial extent slightly smaller in diameter than the outside diameters of said O-rings.

7. The pen of claim 6 wherein the end of said cap opposite said one open end thereof is closed.

8. The pen of claim 6 wherein said enlarged abutment is generally cylindrical and of substantially the same outside diameter as said cap and tubular barrel.

9. The pen of claim 8 wherein the end of said tubular barrel remote from the open end thereof is closed.

10. The pen of claim 9 wherein the end of said cap opposite said one open end thereof is closed.

11. The pen of claim 1 wherein said anchor means comprises a diametric bore formed through the end of said cap remote from said open end through which a keyring may be removably engaged.

* * * * *